US008317473B1

(12) United States Patent
Liang

(10) Patent No.: US 8,317,473 B1
(45) Date of Patent: Nov. 27, 2012

(54) TURBINE BLADE WITH LEADING EDGE EDGE COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 709 days.

(21) Appl. No.: 12/565,057

(22) Filed: Sep. 23, 2009

(51) Int. Cl.
*F01D 5/18* (2006.01)

(52) U.S. Cl. ..... 416/97 R; 416/228; 416/236 R

(58) Field of Classification Search ..... 415/115; 416/95, 96 R, 97 R, 97 A, 228, 235, 236 R
See application file for complete search history.

(56) References Cited

U.S. PATENT DOCUMENTS 4,302,940 A * 12/1981 Meginnis ..... 60/754
4,776,172 A * 10/1988 Havercroft ..... 60/754
5,392,515 A * 2/1995 Auxier et al. ..... 29/889.721
7,021,896 B2 * 4/2006 Dodd ..... 416/97 R
7,500,823 B2 * 3/2009 Bolms et al. ..... 415/115
7,540,712 B1 * 6/2009 Liang ..... 416/1
7,597,540 B1 * 10/2009 Liang ..... 416/97 R
7,789,626 B1 * 9/2010 Liang ..... 416/97 R

* cited by examiner

*Primary Examiner* — Edward Look
*Assistant Examiner* — Ryan Ellis
(74) *Attorney, Agent, or Firm* — John Ryznic

(57) ABSTRACT

A showerhead cooling arrangement for a turbine airfoil in which the showerhead includes a row of film cooling holes on the stagnation point of the leading edge, a row of pressure side film cooling holes, and a row of suction side film cooling holes to form the showerhead. A pattern of grooves is formed on the leading edge surface in both a criss cross shape and three longitudinal shapes and in which the showerhead film cooling holes are located in the grooves. A TBC is applied over the leading edge surface and into the grooves. The grooves retain the TBC and prevent spallation, and the grooves hold the film layer together longer so that the cooling effectiveness is increased.

11 Claims, 6 Drawing Sheets

TURBINE BLADE WITH LEADING EDGE EDGE COOLING

BACKGROUND OF THE INVENTION

1. Field of the Invention

The present invention relates generally to a gas turbine engine, and more specifically to a turbine rotor blade with a showerhead film cooling hole arrangement.

2. Description of the Related Art Including Information Disclosed Under 37 CFR 1.97 and 1.98

A gas turbine engine includes a turbine section with a plurality of stages of stationary vanes and rotary blades to extract mechanical energy from a hot gas flow passing through the turbine. The gas turbine engine efficiency can be increased by providing for a higher temperature of the gas flow entering the turbine. The temperature entering the turbine is limited to the first stage vane and rotor blades ability to withstand the high temperature.

One method of allowing for higher temperatures than the material properties of the first stage vane and blades would allow is to provide for cooling air passages through the airfoils. Since the cooling air used to cool the airfoils is generally bled off from the compressor, it is also desirable to use a minimum amount of bleed off air in order to improve the efficiency of the engine. The compressor performs work to compress the bleed air for use in cooling the airfoils.

The hottest part of the airfoils is found on the leading edge. Complex designs have been proposed to provide the maximum amount of cooling for the leading edge while using the minimum amount of cooling air. One leading edge airfoil design is the showerhead arrangement. In the Prior Art, a blade leading edge showerhead comprises three rows of cooling holes as shown in FIG. 1. The showerhead arrangement 10 of the Prior Art includes a cooling air supply channel 11, a metering hole 13, a showerhead cavity 12, and a plurality of film cooling holes 14. The middle film row is positioned at the airfoil stagnation point which is where the highest heat load is found on the airfoil leading edge. The cooling hole labeled as 14 in FIG. 1 with the arrow indicates the cooling air flow is the stagnation point. The stagnation point is where the highest heat load appears on the airfoil leading edge. Film cooling holes for each row are at inline pattern and at staggered array relative to the adjacent film row as seen in FIG. 4. The showerhead cooling holes 14 are inclined at 20 to 35 degrees relative to the blade leading edge radial surface as shown in FIG. 3.

The Prior Art showerhead arrangement of FIGS. 1-4 suffers from the following problems. The heat load onto the blade leading edge region is in parallel to the film cooling hole array, and therefore reduces the cooling effectiveness. The portion of the film cooling holes within each film row is positioned behind each other as shown in FIG. 3 that reduces the effective frontal convective area and conduction distance for the oncoming heat load. Realistic minimum film hole spacing to diameter ratio n is approximately at 3.0. Below this ratio, zipper effect cracking may occur for the film row. This translates to maximum achievable film coverage for that particular film row to be 33% or 0.33 film effectiveness for each showerhead film row. Since the showerhead film holes are at radial orientation, film pattern discharge from the film hole is overlapped to each other. Little or no film is evident in-between film holes.

To allow for higher temperature exposure, a thin TBC (Thermal Barrier Coating) is used in the turbine airfoil leading edge cooling design to provide additional insulation for the airfoil for the reduction of heat load from the hot gas to the airfoil which reduces the airfoil metal temperature and thus reduces the cooling flow consumption and improves the turbine efficiency. As the turbine inlet temperature increases as turbines improve, the cooling flow demand for cooling the airfoil will increase and thus reduce the turbine efficiency. One alternative way for reducing the cooling air consumption while increasing the turbine inlet temperature for higher turbine efficiency is by using a thicker TBC on the cooled airfoil. Thus, the airfoil cooling design becomes more reliant on the endurance of the coating and thus the TBC becomes the prime design feature of the cooling design for the airfoil. A thicker TBC results in higher chances of spallation (when chips of the coating break away from the airfoil surface and leave exposed metal).

BRIEF SUMMARY OF THE INVENTION

It is therefore an object of the present invention to provide for an improved showerhead arrangement for a turbine airfoil that will use less cooling air than the Prior Art arrangement and produce more cooling of the leading edge.

It is another object of the present invention to provide for a turbine rotor blade with a leading edge showerhead film cooling hole design that will minimize a TBC spallation.

It is another object of the present invention to provide for a turbine rotor blade with a leading edge showerhead film cooling hole design that will reduce the effective thickness of the blade leading edge and thus increase the effectiveness of the backside impingement cooling process.

It is another object of the present invention to provide for a turbine rotor blade with a leading edge showerhead film cooling hole design that will provide for bonding surface area to retain the TBC on the blade leading edge surface.

The above objectives and more are achieved with the turbine blade of the present invention that has a showerhead arrangement of film cooling holes on the leading edge of the airfoil, where the blade leading edge surface has an arrangement of shallow retainer grooves formed in a criss-cross pattern with the film holes opening into the shallow grooves, and where the TBC is applied over the shallow grooves so that the grooves function to retain the TBC onto the leading edge surface more than would a flat surface.

DETAILED DESCRIPTION OF THE INVENTION

The present invention is a showerhead cooling hole arrangement for a leading edge airfoil used in a gas turbine engine.

Figure 1:
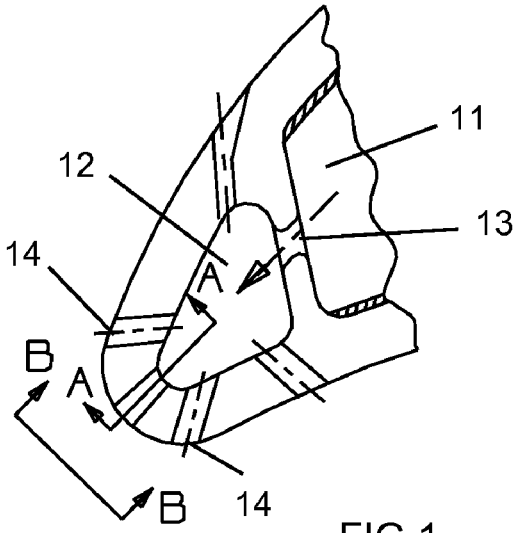
FIG 1 Prior Art
FIG. 1 shows a cross section view of a prior art showerhead film cooling hole arrangement for a turbine airfoil.
Figure 2:
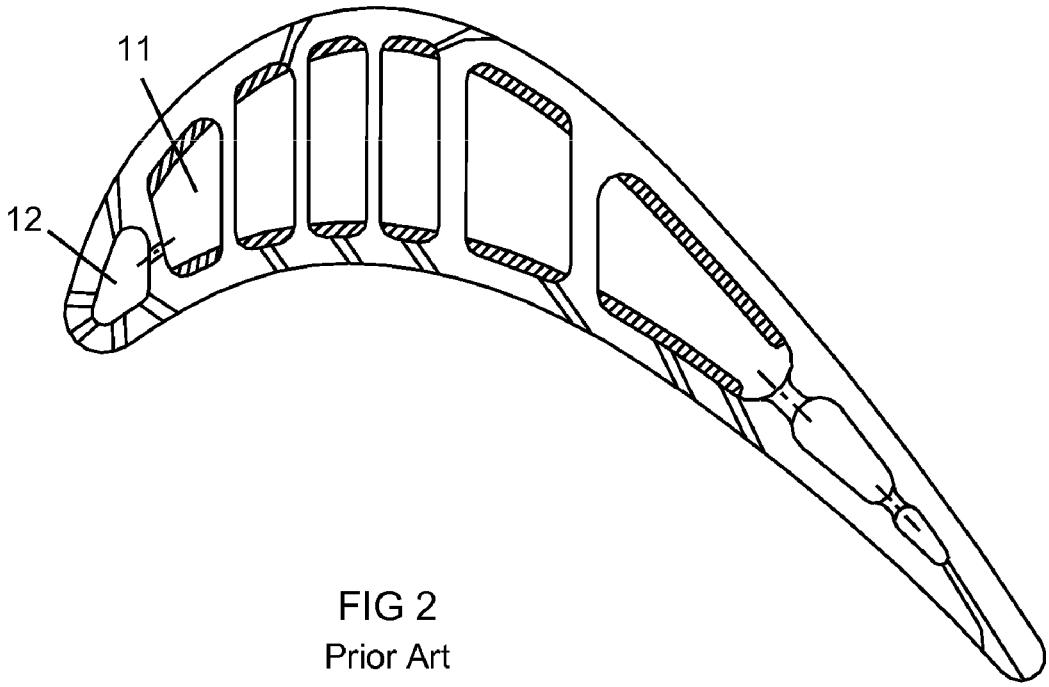
FIG 2 Prior Art
FIG. 2 shows a cross section view of a prior art turbine airfoil cooling circuit with the showerhead arrangement of FIG. 1.
Figure 3:
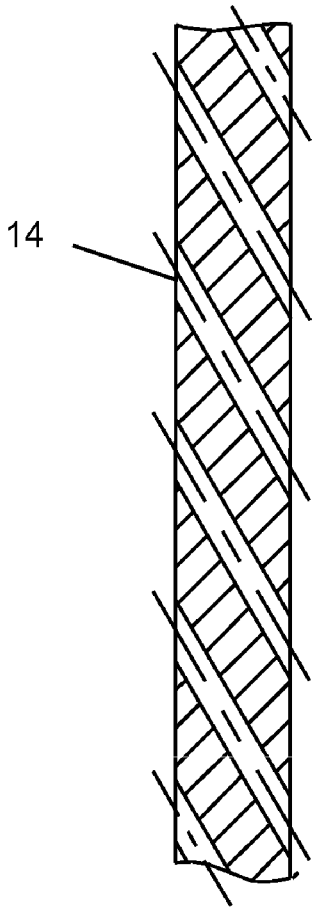
FIG 3 Prior Art
FIG. 3 shows a cross section side view of the prior art showerhead film cooling holes of FIG. 1 through line A-A.
Figure 4:
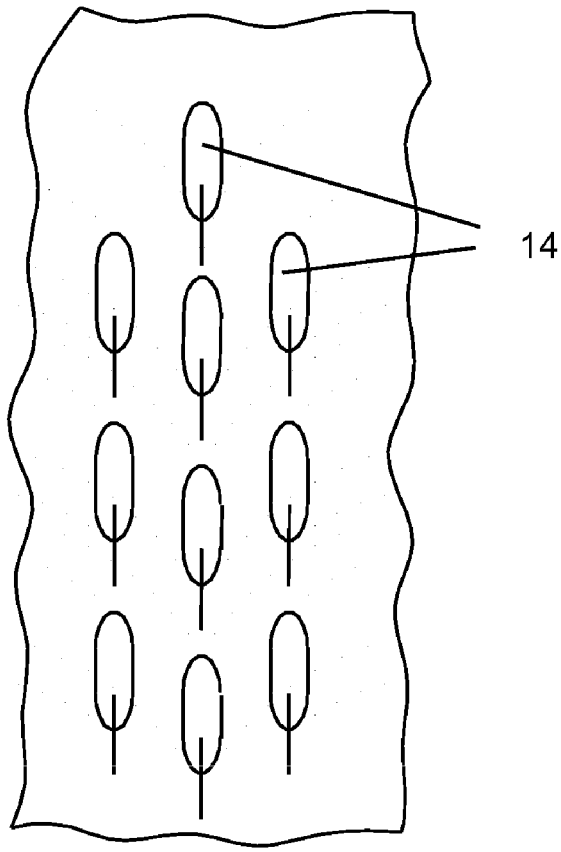
FIG 4 Prior Art
FIG. 4 shows a front view of the leading edge showerhead arrangement of the FIG. 1 prior art turbine airfoil.
Figure 5:
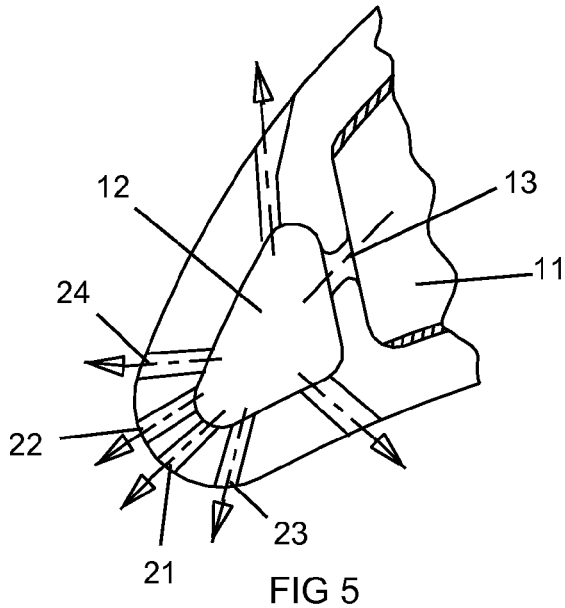
FIG. 5 shows an arrangement of film cooling holes for the leading edge showerhead design of the present invention.

FIG. 5 shows the showerhead on the leading edge of a stationary vane or rotary blade to include the impingement cavity 12, and six film cooling holes opening onto the leading edge surface of the blade. Film cooling holes 21 and 22 are located at the stagnation point. FIG. 5 shows two rows of the film cooling holes 21 and 22 adjacent to each other at the stagnation point. The two holes 21 and 22 are located at the stagnation point such that cooling hole 21 will discharge cooling air and drift toward the pressure side while cooling hole 22 will discharge and drift toward the suction side. However, one row or three rows of cooling holes could be used along the stagnation point. Pressure side film cooling hole 23 and suction side film cooling hole 24 are located on the respective sides of the stagnation point. Two other film cooling holes are located downstream from cooling holes 23 and 24. Holes 21 through 24 form a four hole leading edge showerhead.

Figure 6:
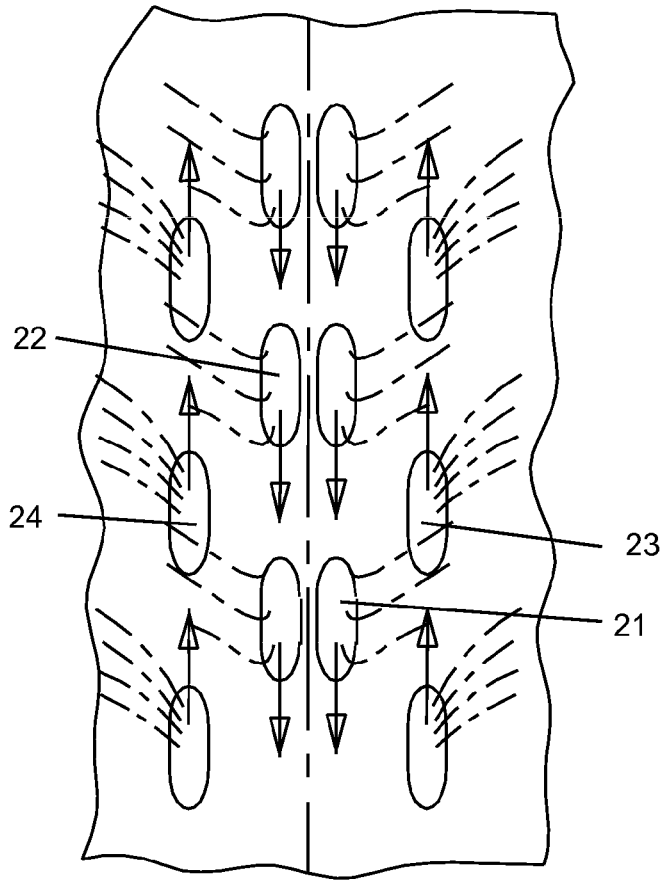
FIG. 6 shows a front view of the showerhead film cooling hole arrangement of FIG. 5.

FIG. 6 shows the main feature of the present invention. Film cooling holes 23 and 24 eject the cooling air in the upward direction from 20 to 35 degrees according in accordance with the cited prior art. The stagnation film cooling holes 21 and 22 eject the cooling air in a downward direction as shown by the arrows in FIG. 6. All four rows of film cooling holes 21-24 extend along the leading edge region of the airfoil along the entire spanwise direction of the airfoil. This arrangement eliminates the film over lapping problem and yields a uniform film layer for the blade leading edge region. In addition, a double holes configuration can be incorporated for the stagnation row. The use of double hole cooling for the leading edge stagnation row will further enhance the stagnation location cooling capability. The blade showerhead arrangement of the present invention increases the blade leading edge film effectiveness to the level above the prior art showerhead arrangement of FIGS. 1-4 and improves the overall convection capability which reduces the blade leading edge metal temperature.

In another embodiment of the film cooling hole arrangement of FIG. 6, the stagnation point film cooling holes 21 and 22 of FIG. 5 are reversed. In this embodiment, the stagnation point film cooling holes 21 and 22 discharges the cooling air in the upward direction while the pressure and suction side cooling holes 23 and 24 discharge the cooling air in the downward direction.

Figure 8:
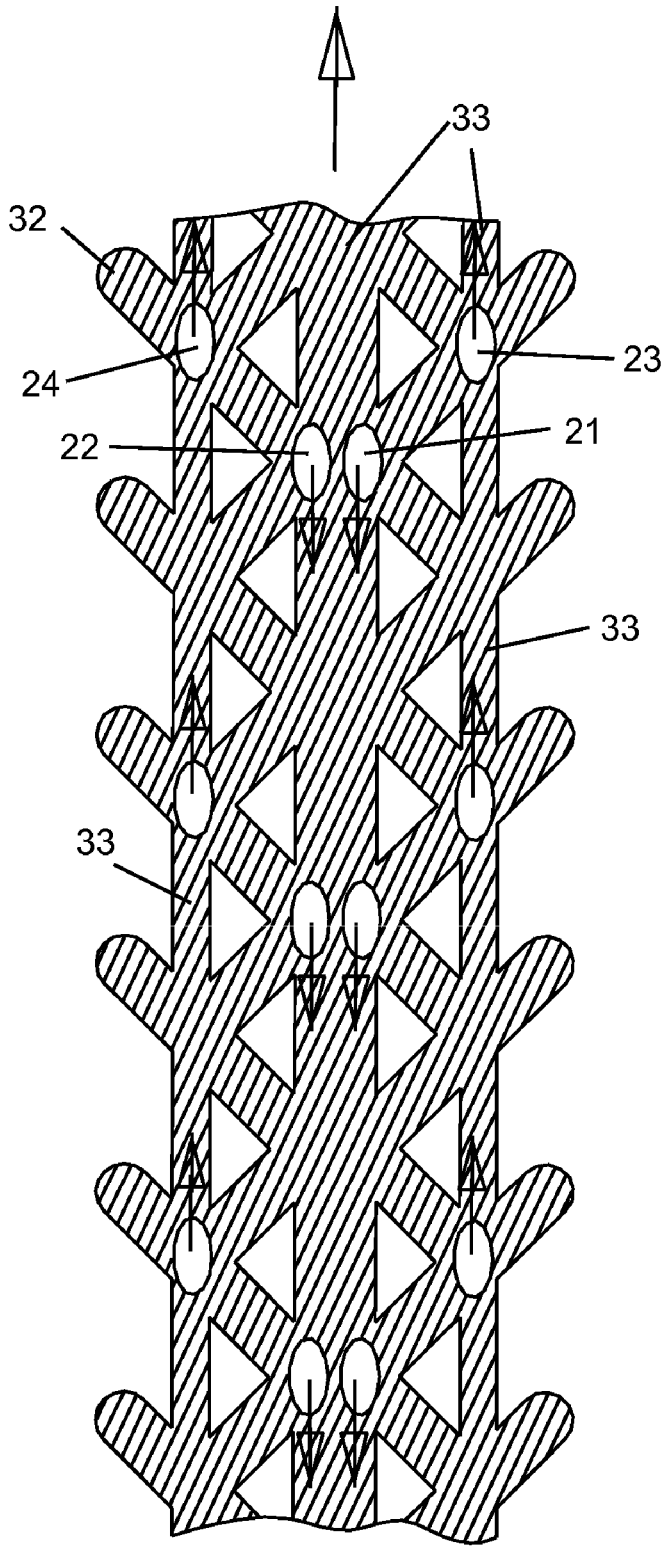
FIG. 8 show a front view of an embodiment of the present invention with a crisscross pattern of shallow grooves along with four rows off film cooling holes for the leading edge of the blade.
Figure 9:
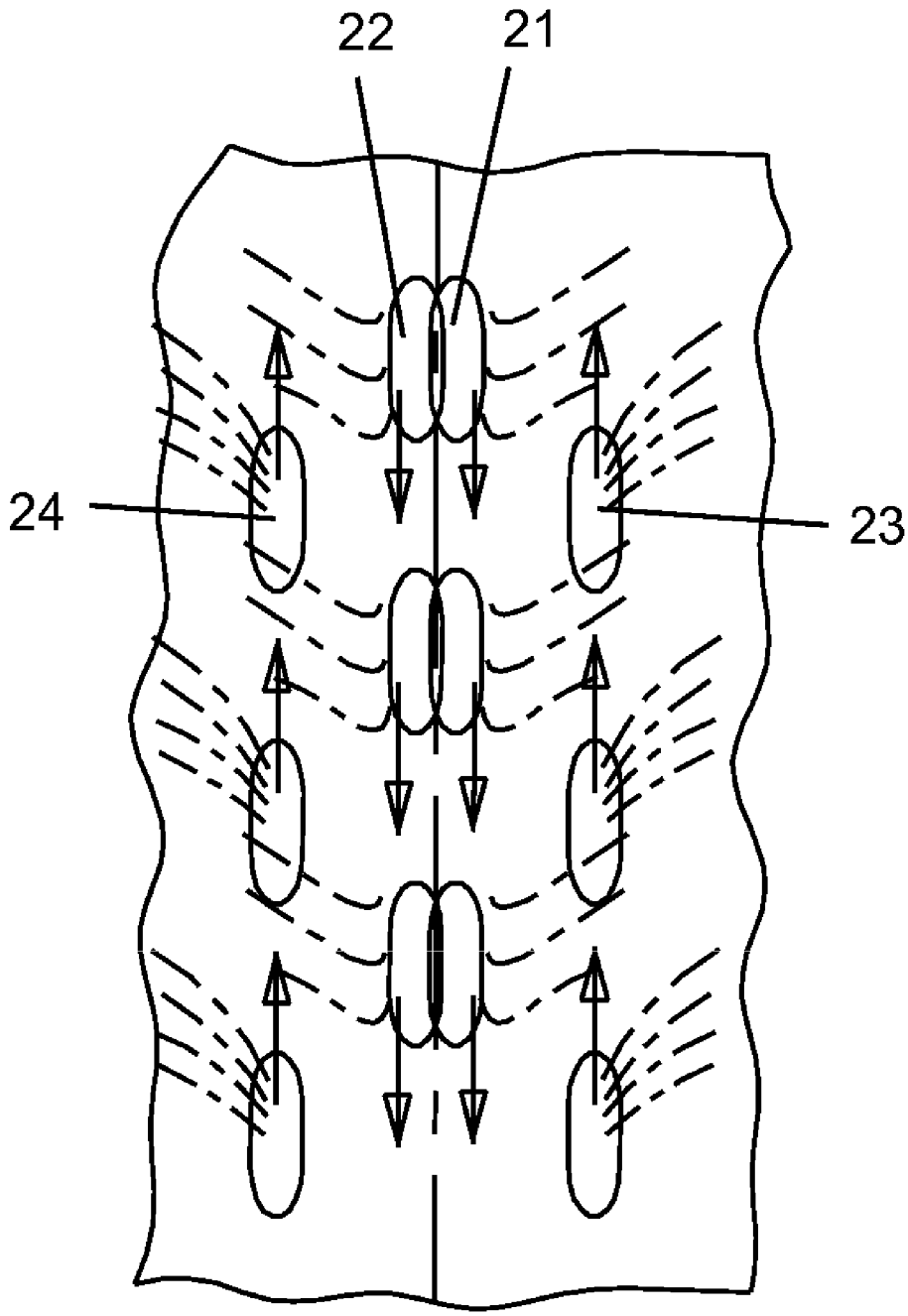
FIG. 9 shows a front view of a showerhead film cooling hole arrangement with a stagnation row of film holes having a FIG. 8 shape according to another embodiment of the present invention.

In still another embodiment of the film cooling hole arrangement of FIG. 6, the two separate stagnation point cooling holes of FIG. 5 are joined together such that cooling air in one hole 21 can flow into the other cooling hole 22. A sideways FIG. 8 is formed within the film cooling holes 21 and 22 when joined as seen in FIG. 9. As in the FIG. 5 and other embodiments, the discharge direction of the cooling holes 21 through 24 can be reversed in the upward and downward direction. The joined cooling holes 21 and 22 are positioned at the stagnation point such that cooling air discharged from hole 21 will drift toward the pressure side and cooling air discharged from hole 22 will drift toward the suction side.

Cooling air is supplied into a cooling supply channel 11 and through a plurality of impingement holes 13 and into the impingement cavity 12 of the leading edge. One long impingement cavity could be used, or a plurality of separate impingement cavities could be used in the present invention. The impingement cavity 12 directs the cooling air through the film cooling holes connected to the cavity.

Figure 7:
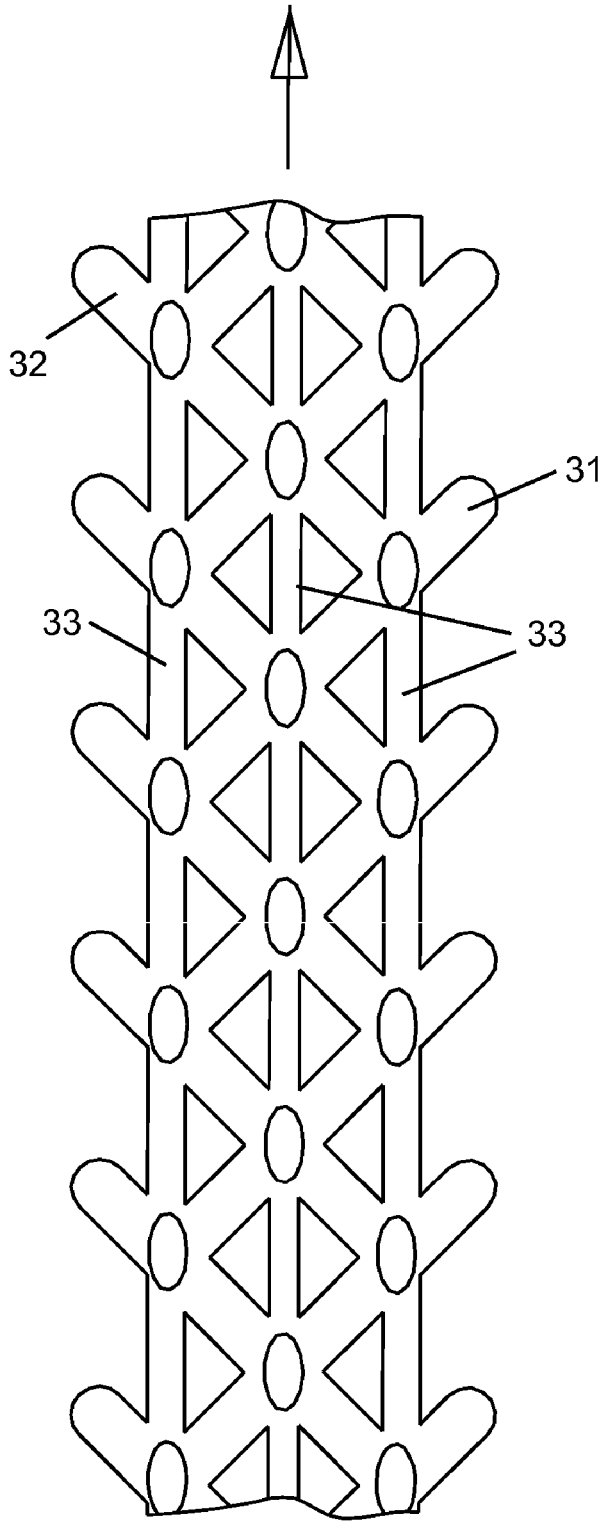
FIG. 7 shows a front view of an embodiment of the present invention with a crisscross pattern of shallow grooves along with three rows off film cooling holes for the leading edge of the blade.

FIGS. 7 and 8 show additional embodiments of the present invention in which the prior art film cooling hole arrangement and the new film cooling hole arrangement of the present invention both include the addition of a criss cross pattern of shallow grooves in which the film holes are located and in which functions to retain the TBC to the airfoil surface better than would a flat metal surface. FIG. 7 shows the prior art three rows of film holes with the middle row located along the stagnation line. A criss cross pattern of grooves 31 and 32 and three longitudinal grooves 33 are formed on the leading edge surface with the three rows of film holes opening into the grooves where two grooves cross one another as seen in FIG. 7. A depth of the grooves is from around two times the film hole diameter to five times the film cooling hole diameter. A diameter of film cooling holes in an aero engine is about 0.014 inches and 0.025 inches for IGT engine. A TBC is applied over the grooves with the film holes opened so that the grooves function to retain the TBC onto the airfoil leading edge surface and prevent spallation. The applied TBC does not cover over the grooves, but does form a thin layer of coating within the grooves so that a groove with a coating still remains on the leading edge surface in which the discharged layer of film cooling air will flow into the coated grooves during the cooling process of the leading edge of the blade.

FIG. 8 shows a leading edge showerhead arrangement of film cooling holes with four rows of film holes like that disclosed in FIGS. 5 and 6, but with the addition of the grooves like that disclosed in FIG. 7. The criss cross pattern of grooves and three rows of longitudinal grooves functions to retain the TBC to the leading edge and prevent spallation. The middle longitudinal shallow groove is wider than in the FIG. 7 embodiment because of the double rows of film holes along the stagnation point. A depth of the grooves is also from around two times the film hole diameter to five times the film cooling hole diameter.

In operation, as the cooling air is discharged from the leading edge film holes, the cooling air is highly ejected in a radial direction and then spreads around the blade leading edge. Spent film cooling air will migrate into the criss cross pattern of grooves and remain within the grooves. As a result of this structure, the layer of film cooling air is retained within the grooves longer so that the film coverage lasts longer and therefore the film effectiveness level is greater. This eliminates the hot streak problem in-between film holes and yields a uniform film layer for the blade leading edge region. The criss cross pattern of retainer grooves will also increase the leading edge section cooling side retaining surface area by a reduction of the hot gas convection surface area from the hot gas side, which therefore results in a reduction of the heat load from the blade leading edge. The retainer grooves also reduce the effective thickness for the blade leading edge so that the effectiveness of the leading edge backside surface impingement cooling is also greater.

For a blade coated with a thick TBC, the criss cross pattern of grooves provides more bonding surface area to retain the TBC onto the blade leading edge. As the TBC is applied onto the cooled blade leading edge surface, the TBC material will fill in the grooves and thus form an attachment mechanism for the TBC. During engine operation, expansion of the airfoil metal due to increase of airfoil metal temperature will compress the TBC formed within the grooves and therefore more firmly secured the TBC to the leading edge surface.

I claim the following:

1. A turbine airfoil with a showerhead arrangement to provide cooling for the leading edge of the airfoil, the airfoil having an impingement cavity to deliver cooling air to film cooling holes forming the showerhead, the showerhead arrangement comprising:

a first row of film cooling holes located in a stagnation point on the leading edge of the airfoil, the first row of cooling holes having an ejecting direction in one of an upward direction and a downward direction;

a second row of film cooling holes adjacent to the first row and on the pressure side of the leading edge;

a third row of film cooling holes adjacent to the first row and on the suction side of the leading edge;

the second and third row of film cooling holes having an ejecting direction in the other of the upward and downward direction opposed to the first row direction;

the three rows of film cooling holes each extends along substantially all of the airfoil surface in a spanwise direction;

a criss cross pattern of grooves formed on the leading edge surface with the film cooling holes located within a groove; and, a thermal barrier coating on the leading edge surface and in the grooves.

2. The turbine airfoil of claim 1, and further comprising:

the first row of film cooling holes includes only two rows.

3. The turbine airfoil of claim 2, and further comprising:

the two rows are relatively closely spaced.

4. The turbine airfoil of claim 2, and further comprising:

the two rows are joined together.

5. The turbine airfoil of claim 2, and further comprising:

the pressure side row of the first row stagnation point cooling holes discharges cooling air toward the pressure side; and, the suction side row of the first row stagnation point cooling holes discharges cooling air toward the suction side.

6. The turbine airfoil of claim 1, and further comprising:

three longitudinal rows of grooves on the leading edge surface intersecting the criss cross pattern of grooves;

the film cooling holes also being located in the longitudinal grooves; and, the thermal barrier coating also being in the longitudinal grooves.

7. A turbine rotor blade comprising:

a root section with a platform;

an airfoil section extending from the root section;

the airfoil section having a leading edge with a pressure side wall and a suction side wall extending from the leading edge to define the airfoil section;

a showerhead arrangement of film cooling holes connected to a cooling air supply cavity internal to the airfoil section;

the showerhead film cooling holes extending along the entire airfoil surface from adjacent to the platform to a blade tip region;

the showerhead film cooling holes including two rows of film cooling holes located in a stagnation point of the leading edge and directed to discharge film cooling air toward the platform end of the airfoil; and, the showerhead film cooling holes including a row of film cooling holes on the pressure side and on the suction side of the stagnation point both directed to discharge film cooling air toward the blade tip end of the airfoil; and, a criss cross pattern of grooves formed on the leading edge surface with the film cooling holes located within a groove; and, a thermal barrier coating on the leading edge surface and in the grooves.

8. The turbine rotor blade of claim 7, and further comprising:

the two rows of film cooling holes along the stagnation point are separate film cooling holes.

9. The turbine rotor blade of claim 8, and further comprising:

the two rows of film cooling holes along the stagnation point are closely spaced from one another.

10. The turbine rotor blade of claim 7, and further comprising:

the two rows of film cooling holes along the stagnation point are connected film cooling holes that form a FIG. 8 cross section.

11. The turbine rotor blade of claim 7, and further comprising:

three longitudinal rows of grooves on the leading edge surface intersecting the criss cross pattern of grooves;

the film cooling holes also being located in the longitudinal grooves; and, the thermal barrier coating also being in the longitudinal grooves.

* * * * *